United States Patent [19]

Ejima et al.

[11] 4,189,338

[45] Feb. 19, 1980

[54] METHOD OF FORMING AUTOGENOUSLY BONDED NON-WOVEN FABRIC COMPRISING BI-COMPONENT FIBERS

[75] Inventors: Shozo Ejima; Susumu Tomioka; Tadao Matsumoto; Naruaki Hane, all of Moriyamashi, Japan

[73] Assignee: Chisso Corporation, Osaka, Japan

[21] Appl. No.: 600,037

[22] Filed: Jul. 29, 1975

Related U.S. Application Data

[63] Continuation of Ser. No. 419,165, Nov. 26, 1973, abandoned.

[30] Foreign Application Priority Data

Nov. 25, 1972 [JP] Japan ..... 118322

[51] Int. Cl.[2] ..... D04H 3/14; D01F 8/06

[52] U.S. Cl. ..... 156/167; 156/181; 156/306; 264/168; 264/171; 264/210.8; 264/DIG. 26

[58] Field of Search ..... 156/181, 296, 290, 167, 156/306, 229, 84; 428/374, 371, 296, 370; 264/DIG. 26, 168, 171, 210 F

[56] References Cited

U.S. PATENT DOCUMENTS

| | | | |
|---|---|---|---|
| 2,987,797 | 6/1961 | Breen | 428/370 |
| 3,399,259 | 8/1968 | Brayford | 264/168 |
| 3,505,164 | 4/1970 | Oppenlander | 428/370 |
| 3,509,013 | 4/1970 | Oppenlander | 264/171 |
| 3,589,956 | 6/1971 | Krantz et al. | 156/306 |
| 3,595,731 | 7/1971 | Davies et al. | 156/306 |
| 3,718,534 | 2/1973 | Okamoto et al. | 264/171 |
| 3,781,399 | 12/1973 | Kobayashi et al. | 264/171 |

*Primary Examiner*—Michael W. Ball
*Attorney, Agent, or Firm*—Fred Philpitt

[57] ABSTRACT

A porous non-woven fabric having a good dimensional stability and uniformity is prepared from a web obtained by arranging side-by-side composite fibers alone or a blend thereof with another fibrous material into a web and heat-treating the resulting web at a specified temperature, said composite fibers having few naturally developed crimps and being obtained by stretching unstretched side-by-side composite fibers consisting of a polypropylene component and an olefin polymer component having a specified melting point and a specified melt flow rate.

7 Claims, 4 Drawing Figures

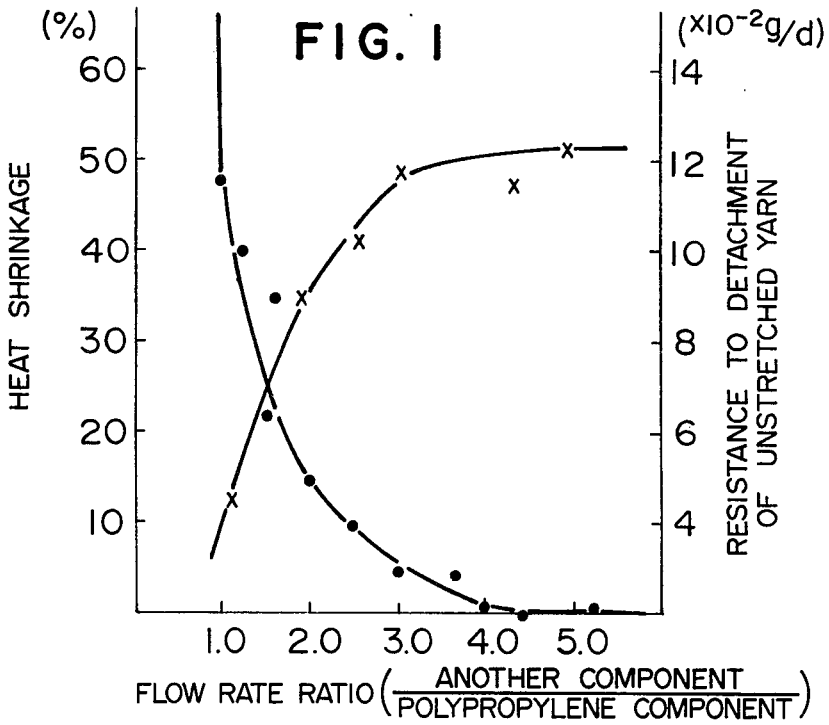
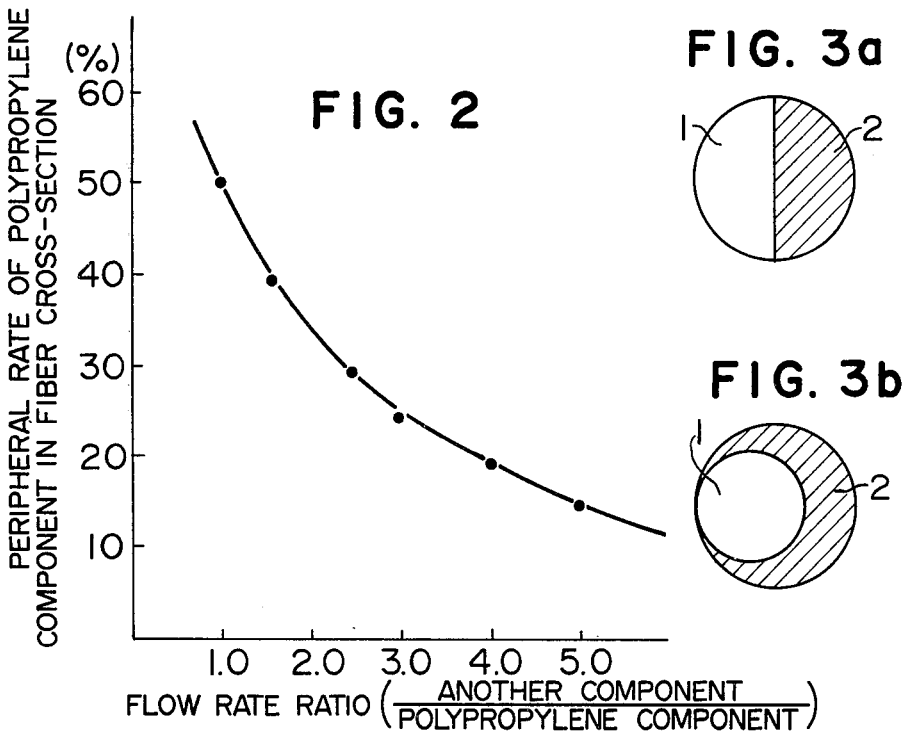
FIG. 3a
FIG. 3b

METHOD OF FORMING AUTOGENOUSLY BONDED NON-WOVEN FABRIC COMPRISING BI-COMPONENT FIBERS

This is a continuation of application Ser. No. 419,165, filed Nov. 26, 1973, now abandoned.

DISCLOSURE OF THE INVENTION

This invention relates to porous non-woven fabrics having good dimensional stability and uniformity which are obtained by using polyolefin composite fibers having adhesiveness, extremely small heat-shrinkage and superior undetachability of side-by-side type composite components.

Recently there are many reports relating to the art of non-woven fabrics prepared by using, as adhesive fibers, composite fibers of a combination of high molecular weight polymers having different melting points. For example there is Japanese Patent Publication Sho 42-21318 an an example of side-by-side type composite fibers and Japanese Patent Publication Sho 44-24508, 45-2345, etc. as examples of sheath and core type composite fibers.

But according to the present art, side-by-side type and sheath and core type composite fibers both have serious drawbacks. Namely, according to conventional technique for preparing non-woven fabrics through side-by-side composite fibers, it is intended to prepare characteristic non-woven fabrics by developing crimps at the time of processing of non-woven fabrics under utilization of latent crimpability which is specific of composite fibers consisting of different components to improve entanglement of fibers with each other. But it is well known that composite fibers having good latent crimpability are accompanied with a great shrinkage at the same time with the crimp-development. Generation of shrinkage at the time of making webs into non-woven fabrics improves interfilamentary entanglement to give elastic non-woven fabrics, but, on the other hand, when webs are continuously made into non-woven fabrics, webs are accompanied with a great shrinkage at the time of crimp-development, to give non-woven fabrics deficient in uniformity of width and thickness and having unevenness of density. Further, when non-woven fabrics subjected to melt-adhesion only at the surface part, such as those useful for kilt, are prepared, there is a drawback that shrinkage occurs only at the surface layer to form wrinkles. Thus, even if characteristic non-woven fabrics are obtained in laboratory by the use of these conventional composite fibers having latent crimpability, their characteristics cannot be well effected in the case of mass production, on account of the above-mentioned defects, to make their commercialization difficult. Such is the present situation.

Further it is generally well known as a drawback of side-by-side type composite fibers that polymers arranged in side-by-side relationship are easily detached. When detachment occurs in non-woven fabrics, denier of fibers becomes smaller and fabrics are brought to the state in which fibers having different melting points are merely blended, and since the component of higher melting point is brought to the state in which it is existent in a free state in the non-woven fabrics formed by adhesion thereof to the component of lower melting point, the strength of the resulting non-woven fabrics is reduced.

Methods for improving only the above-mentioned defect of easy detachability are disclosed in Japanese Patent Publications Sho 43-4537, 47-14765, etc. But methods of preventing the detachment physically by forming a particular shape along the boundary of the two components are not preferred on account of reduction in spinnability, and hence reduction in producibility.

On the other hand, in case of sheath and core type composite fibers, latent crimpability is reduced and in this sense the above-mentioned defect of side-by-side type composite fibers may be alleviated. But when the sheath part thereof is composed of a lower melting point component, the bulkiness and elasiticity of the resultant non-woven fabrics are reduced because adhesion of the two components in the non-woven fabric is effected entirely along the contacting part thereof. Thus, characteristic non-woven fabrics cannot be obtained. To the contrary, when the core part thereof is composed of a lower melting point component, the adhering part is reduced to make the strength of the resulting non-woven fabric insufficient.

Polyolefin fibers have excellent characteristic properties suitable for non-woven fabrics, but they have hardly been used for non-woven fabrics because of difficulty in adhesion at crossing points or contacting points of fibers, and even when an improvement has been made in this respect, situation has not been changed because of the above-mentioned drawback.

The inventors of this invention have been studying earnestly to overcome these drawbacks and obtain characteristic non-woven fabrics by using polyolefin fibers, and as a result, the present invention has been attained.

A first object of this invention is to provide non-woven fabrics of porous structure, which are characterized in that side-by-side type composite fibers of polyolefins having small heat shrinkage, and superior in the undetachability of composite components arranged in side-by-side relationship are used as the whole or as a part of the fibers constituting the non-woven fabrics; by the use of such composite fibers, preparation of non-woven fabrics becomes easy and dimensional stability during the preparation is imparted; and the resulting non-woven fabrics are rich in uniformity and further stabilized mainly due to melt-adhesion during the preparation.

A second object is to provide a method for producing the above-mentioned non-woven fabrics.

The first object of this invention is achieved by a non-woven fabric which is produced by subjecting a web containing at least 10% by weight, preferably at least 30% by weight, of side-by-side type composite fibers having naturally developed crimps of 12 crimps/25 mm or less, and consisting of a polypropylene component and an olefin polymer component having a melting point lower than that of said polypropylene component by 20° C. or more, preferably 30° C. or more, and a melt flow rate (referred to hereinafter as MFR, the measuring method of which will be given also hereinafter) of 1.5 to 5 times, preferably 2–4 times, that of said polypropylene component, to heat-treatment at a temperature lower than the melting point of the higher melting component and higher than the melting point of the lower melting component.

The second object of this invention is achieved by a production method which is characterized by forming a web containing at least 10% by weight, preferably at least 30% by weight, of side-by-side type composite fibers having naturally developed crimps of 12 crimps/25 mm or less which are obtained by stretching unstretched side-by-side type composite fiber having the above-mentioned composite constitution, at a stretching temperature lower than the melting point of the lower melting component by 20° C. or at a higher temperature than said temperature and in a stretching ratio of 3 or more, and subjecting the resultant web to heat-treatment at a temperature lower than the melting point of the higher melting component and higher than that of the lower melting component. The melt-flow rate and melting-point referred to herein are those in the state constituting the fibers i.e. those of the materials after spinning.

It is preferable that the crystalline polypropylene in the polypropylene component is included in an amount of at least 85% by weight.

The composite fibers after stretched, to be used in the present invention have spiral crimps or U-shaped crimps formed by mechanical crimping after stretching as mentioned below. The web containing these composite fibers is bulky, porous and are turned into non-woven fabrics by the heat treatment at a temperature higher than the melting point of the lower melting component and lower than the melting point of the higher melting component to form junction points at the contact parts of the lower melting component. At this time the web is scarcely accompanied with heat shrinkage as described later also, and hence the web is turned into non-woven fabrics while holding its width and thickness in uniform state and bulkiness and porosity, as they are. Thus, non-woven fabrics which are porous and superior in dimensional stability and uniformity can be obtained.

In spite of the fact that polypropylene is inherently a most suitable and economical raw material of synthetic fibers in the application field of non-woven fabrics, particularly those where strength, acid-resistance, alkali-resistance, resistance to chemicals, etc. are required, it is the present status that non-woven fabrics of polypropylene have not been widely used because any suitable adhesive and any adhesion method have not been established up to the present time. According to the method of the present invention, since problems relating to adhesion can be easily solved, it has become possible for this material also to be used advantageously by making the most of their properties suitable for raw material of non-woven fabrics.

By using an olefin polymer which is in the same class with polypropylene, as the other composite component to be combined with polypropylene, the drawback of composite fibers composed of two different components i.e. the drawback that they are easily detached into the two constituting components has been overcome, and spinnability and stretchability at the time of forming composite fibers have been improved.

By using, as an olefin polymer component to be combined with a polypropylene component, those polymers whose melting point is lower than that of polypropylene by 20° C. or more, preferably 30° C. or more, a relatively low temperature is sufficient for the temperature of heat treatment which causes the melt-adhesion of the lower melting component of the composite fibers at crossing and contacting points, but if the melting point difference is lower than 20° C., this is not preferable because the polypropylene component also takes part in adhesion, and deformation and heat-deterioration occur.

The ratio of the melt flow rate of an olefin polymer component to that of a polypropylene component, after composite spinning, (hereinafter often referred to as flow rate ratio) has an important relationship with the uniformities in width and thickness and stability, at the time of convertion processing into non-woven fabrics. In the present invention, a flow rate ratio in the range of 1.5 to 5 is used, but spinning is preferably carried out to give a flow rate ratio in the range of 2 to 4.

The present invention will be more fully described referring to accompanying drawings in which FIG. 1 shows the relationship between flow rate ratio and heat shrinkage of non-woven fabrics and the relationship between flow rate ratio and resistance to detachment of unstretched yarns;

FIG. 2 shows the relationship between flow rate ratio and peripheral rate of polypropylene component in fiber cross-section; and FIG. 3*a* and FIG. 3*b* show cross-sectional shapes of side-by-side composite fibers composed of polypropylene component and a lower melting component.

According to our study, it has been found that when the flow rate ratio is smaller than 1.5 times, the resultant composite fibers exhibit superior latent crimpability; when they are turned into composite fibers, heat shrinkage becomes more than 20%; the processability for turning into non-woven fabrics is exceedingly reduced; and resistance to detachment between two side-by-side polymers is not sufficient, as seen from FIG. 1. When a flow rate ratio is greater than 5, there is no latent crimpability and heat shrinkage at the time of turning into non-woven fabrics is zero, but the olefin polymer component takes the state enveloping polypropylene component; the outside part forming the polypropylene component is reduced, as seen from FIG. 2, to less than 15% of the total outside part; the part occupied by the olefin polymer component becomes greater; the resulting composite fibers come close to sheath-core-type ones; and non-woven fabrics prepared therefrom can not achieve the object of the present invention.

With the increase of flow rate ratio, heat shrinkage at the time of turning into non-woven fabrics is reduced. It is believed that the reason for it lies in the following point though the value of the present invention is not changed by the exactness of this theory:

During the process of temperature elevation when turning into non-woven fabrics is carried out at a melting point or at a temperature higher than the melting point of the lower melting component, said component is accompanied with a large heat shrinkage at a temperature close to the softening point of that component, whereby the composite fibers tend to exhibit strain. However, with the increase of flow rate ratio, the ratio of polypropylene component occupying the outer part in the form of the cross-section of the composite fibers is reduced, which results in a form constituting a core part, and polypropylene component works to show the effect resistant to the strain i.e. works to show the effect reducing the latent crimpability. Accordingly, the extent of promoting entanglement of fibers constituting the web i.e. the composite fibers having such a large flow rate ratio, during the process of temperature elevation, is extremely smaller compared with that composed of fibers having a good latent crimpability. When a temperature at the time of turning into non-woven fabrics is the melting point of a lower melting component or a temperature higher than that, the lower melting component is in a fluidizable state, and the strain formed by the difference of heat shrinkage of two components tends to be alleviated. However, when the entanglement of composite fibers constituting the web at this time is not so advanced, the entanglement becomes less and less due to the alleviation of strain, and fibers are liable to easily separate from each other by slipping, and hence the heat shrinkage of the resultant non-woven fabrics is smaller. However, as is the case of a number of the above-mentioned prior arts, those in which interfilamentary entanglement is strengthened by the use of composite fibers having a good latent crimpability, are slightly changed in the entanglement due to the alleviation of strain through temperature elevation, but the entanglement is still strong and separation of fibers by slipping is not easy, and hence heat shrinkage of non-woven fabrics is large.

With the increase of flow rate ratio, resistance to detachment of two components is increased. When the flow rate ratio is close to 1, a filament has a cross-section like that shown in FIG. 3*a*. As shown in FIG. 2, if a ratio of outer part is close to 1:1 (50%) and flow rate ratio becomes larger, a lower melting component 2 begins to wrap a higher melting component 1 in its cross-section as indicated in FIG. 3*b*, to give a structure difficult to detach morphologically, and the contact area of lower melting component and higher melting component is increased.

As for spinning method, a spinning method for conventional well known side-by-side type composite fibers can be used.

There is no particular limitation to proportion of composite components, but it is preferable that a lower melting component is in the range of 40–70 percent by weight.

As for polypropylene used in the present invention, those having fiber-forming property and being spinnable by melt-spinning process are useful and most of them have a MFR of 3–20.

As for the principal component of an olefin polymer component having a melting point lower than that of polypropylene component by 20° C. or more, preferably 30° C. or more, a polyethylene having fiber-forming property as a composite component and a melt index (abbreviated as M.I., the method of measurement will be described hereinafter) of 9–34, an atactic polypropylene having an average molecular weight of 30,000–100,000 and a M.P. of 100°–140° C. or a mixture of these, are useful. So long as the difference of melting points between two composite components is 20° C. or more, preferably 30° C. or more, and also so long as a flow rate ratio satisfies the above-mentioned condition, addition of the principal component of one composite side to another composite side or addition of a component other than the above-mentioned principal component of the olefin polymer component to either one or both of the two composite sides is not harmful to the object of the present invention.

The stretching of the composite fibers is carried out at a temperature lower than the melting point of the lower melting component by 20° C. or a higher temperature than said temperature and in a stretching ratio of 3 or more. When stretching is carried out at a temperature lower than said temperature, the difference between the respective elastic shrinkages of the two components becomes greater, and excessive spiral crimps are developed, which results in poor processability of webs and moreover webs have latent crimpability. Accordingly, such a lower temperature makes it difficult to achieve the object of the present invention. There is no particular restriction to the upper limit of stretching temperature and a temperature in the range where no substantial interfilamental melt-cohesion occurs, is employed.

The reason for selecting a stretching ratio of 3 or more is that even when other constituting conditions in the present invention are adopted, a stretching ratio lower than 3 gives a greater latent crimpability and hence a greater shrinkage of web at the time of heat treatment, and achievement of the object of the present invention becomes difficult. There is no particular restriction to the limit of stretching ratio. A stretching ratio which does not make the stretching substantially inoperable by the frequent occurences of breakage of filaments, can be used. Such a limit is usually about 6 in most cases. The composite fibers stretched by the above-mentioned conditions develop a small number of spiral crimps of 12 crimps/inch or less due to a slight difference between the respective elastic shrinkages of the components, but in this case, latent crimpability still remaining is extremely low.

When there is an apprehension that web-forming through a processing step such as carding or the like from the fibers having crimps less than about 8 crimps/inch may bring about obstacle, zigzag type crimps are mechanically added by passing through a crimper commonly used, such as a stuffer box type crimper so that processing of web may be easily carried out. In this case, the crimps of composite fibers take U-shape as a result of this processing, because zigzag crimp effected by crimper is added onto the above-mentioned slight extent of spiral crimps.

With regard to other kinds of fibers to be mixed with the composite fibers in the present invention, it is necessary that they do not melt by the heat treatment of web. Accordingly, so long as fibers have melting points higher than the heat processing temperature or do not bring about change of nature such as carbonization or the like, it does not matter whatever kinds they are. For example, one or more than one kind of natural fibers such as cotton, wool or the like, semisynthetic fibers such as viscose rayon, cellulose acetate fibers, synthetic fibers such as olefin polymer fibers, polyamide fibers, polyester fibers, acrylonitrile polymer fibers, acrylic polymer fibers, polyvinyl alcohol fibers or the like, inorganic fibers such as glass fibers, asbestos or the like, are used after proper selection. It is necessary that the latent crimpability of these fibers is at the highest equal to or smaller than that of the above-mentioned composite fibers and as for the amount thereof used, they are mixed with the composite fibers, at a rate of 90% or less, preferably 70% or less, based upon the the total amount. When the composite fibers of the present invention are included in an amount of about 10%, a certain extent of adhesive effect can be expected while holding the advantage of the present invention. For example, the resultant products can be sufficiently used for such application fields as sound absorbing material and sound insulating material. However, for the application fields requiring strength, an amount of about 30% is necessary in general, and the effectiveness of the present invention can be notably exhibited by using 30% or more. With regard to blending method, any of blending methods such as blending in the cotton-like state or in the tow state are useful.

100% of said composite fibers or blends of said composite fibers with other fibers are collected in proper form such as parallel webs, cross web, random webs, tow webs, etc. and turned into non-woven fabrics.

With regard to the heat treatment carried out with the object of turning webs into non-woven fabrics, it can be carried out by using any heating medium such as dry heating and steam heating. By the heat treatment, a lower melting component of the composite fibers is turned into a melted state and is allowed to strongly melt-adhere with polyolefin part of contacting fibers, particularly with a lower melting component of the same kind. The number of crimps of said composite fibers hardly changes by this heat treatment. Accordingly, the stabilization as non-woven fabrics hardly depends upon entanglement of crimps and depends almost upon melt-adhesion.

The addition of titanium, pigment and other materials to the composite component used in the present invention is allowable so long as the object of the present invention can be attained.

The present invention will be illustrated by the following non-limitative examples.

Measuring methods and definitions of various characteristic properties used in the present invention will be shown collectively as follows:

Melt index (MI): based upon ASTMD-1238(E) (190° C., 2160 g)

Melt flow rate (MFR): based upon ASTM D-1238(L) (230° C., 2160 g)

Percentage shrinkage in area: a web having a size of 25 cm×25 cm is heat-treated in the free state. The lengths in the longitudinal and transversal directions a cm and b cm after heat treatment are measured, and percentage shrinkage in area is measured according to the following formula:

$$\text{Percentage shrinkage in area \%} = \left(1 - \frac{a \times b}{25 \times 25}\right) \times 100$$

Resistance to detachment: Samples of unstretched yarns having a yarn length of 10 cm and peeled off at the end by 2 cm in advance were set to the chuck of Tensilon (supplied from Toyo Sokuki, Japan) and strengths were measured at a pulling velocity of 20 mm/minute and converted into strengths per denier.

Percentage of peripheral length of fiber section: Percentage of a peripheral length occupied by a specified component relative to the total peripheral length of section of composite fibers.

Number of crimps after heat-treatment: In each Example and Comparative Example, the composite fibers after stretching are heat-treated under the same conditions as in heat-treatment for conversion into nonwoven fabrics, and then the number of crimps per 25 mm is observed under a load of 10 mg/denier. By this number is assumed the number of crimps of the composite fibers in the nonwoven fabrics after heat-treatment of web.

EXAMPLE 1

A crystalline polypropylene containing 0.71% of hexane-soluble component and having an intrinsic viscosity of 1.70 (as measured in tetralin at 135° C.) as a first component and a low pressure polyethylene having a melt index (M.I.) of 10.5 as a second component were arranged in a ratio of 50:50, and the first component was melt-extruded at 320° C. and the second component, at 280° C. to spin into side-by-side type composite fibers. The melt flow rate (hereinafter often abbreviated as flow rate) of the first component after spinning at this time was 10.5, and the flow rate of the second component after spinning was 16.8, thus the ratio of these flow rates was 1.6.

The melting point of the first component after spinning was 168° C. and that of the second component was 132° C.

The resistance to detachment of this unstretched composite yarn was 7.0 ($g/d \times 10^{31\ 2}$), and the percentage of peripheral length of fiber section of the second component was 60%. The resultant yarn was stretched to 4 times the original length at 120° C. and cut, and the resulting staple fibers having 18 denier and length of 64 mm and spiral crimps of 8 crimps per 25 mm were formed into webs of 200 $g/m^2$ by using a roller card, and then heat-treated at 140° C. for 5 minutes by hot air dryer. The latent shrinkage was so small that the shrinkage in area after the treatment was only 1%, and a porous non-woven fabric having a uniform surface property and a good dimensional stability and making a good use of characteristics of bulky webs was obtained. The properties of this non-woven fabric were as follows:

Percentage shrinkage in area was 1%; percentage of vacant space was 96.9%; and thickness was 10 mm. Number of crimps after heat treatment was 6.

EXAMPLE 2

Properties of composite fibers and non-woven fabric which were obtained through the steps of spinning, stretching and processing to non-woven fabric under the same conditions as in Example 1 except for the use of the crystalline polypropylene used in Example 1 as a first component and a low pressure polyethylene having a M.I. of 29.2 as a second component, were as follows:

Unstretched composite yarn:

| | |
|---|---|
| the second component | melting point 131° C.<br>MFR 45.2 (flow rate ratio 4.3)<br>percentage of peripheral length in fiber section 81% |
| Resistance to detachment | 12.0 ($g/d \times 10^{-2}$) |
| Stretched composite yarn: | |
| Number of crimps | 7 (crimps/25 mm) |
| Non-woven fabric: | percentage of shrinkage in area, 0%<br>percentage of vacant space, 96.8%<br>thickness 9mm |
| Number of crimps after heat-treatment | 5 (crimps/25 mm) |

COMPARATIVE EXAMPLE 1

Properties of composite fibers and non-woven fabric which were obtained through the steps of spinning, stretching and processing to non-woven fabric under the same conditions as in Example 1 except for the use of the crystalline polypropylene used in Example 1 as a first component and a low pressure polyethylene having a M.I. of 7.1 as a second component, were as follows:

Unstretched composite yarn:

| | |
|---|---|
| second component | melting point 132° C.<br>MFR 10.5 (flow rate ratio 1.0)<br>percentage of peripheral length in fiber section 50% |

-continued

| | |
|---|---|
| Resistance to detachment | 3.4 (g/d × $10^{-2}$) |
| Stretched composite yarn: | |
| Number of crimps | 14 (crimps/25 mm) |
| Non-woven fabric: | percentage of shrinkage in area 9%<br>percentage of vacant space 95.0%<br>thickness 13 mm |
| Number of crimps after heat-treatment 22 (crimps/25 mm) | |

The non-woven fabric thus obtained was a particular one having a foam-like or sponge-like shape, a large elasticity and a small percentage of vacant space.

COMPARATIVE EXAMPLE 2

Properties of composite fibers and non-woven fabric obtained through the steps of spinning, stretching and processing to non-woven fabric under the same conditions as in Example 1 except for the use of a low pressure polyethylene having a M.I. of 35.0 as a second component in place of that of Comparative Example 1, were as follows:

Unstretched composite yarn:

| | |
|---|---|
| second component | melting point 131° C.<br>MFR 55.7 (flow rate ratio 5.3)<br>percentage of peripheral length in fiber section 86% |
| Resistance to detachment | 12.4 (g/d × $10^{-2}$) |
| Stretched composite yarn: | |
| Number of crimps | 6 (crimps/25 mm) |
| Non-woven fabrics: | percentage shrinkage in area 0%<br>percentage of vacant space 96.8%<br>thickness 7 mm |

COMPARATIVE EXAMPLE 3

Composite fibers and non-woven fabric prepared under the same conditions as in Example 1 except that stretching was carried out at 75° C., had following properties:

Stretched Composite yarn:

| | |
|---|---|
| Number of crimps | 16 (crimps/25 mm) |
| Non-woven fabric: | percentage shrinkage in area 13%<br>percentage of vacant space 94.4%<br>thickness 14 mm |
| Number of crimps after heat-treatment 30 crimps/25 mm) | |

The non-woven fabric thus obtained was a particular one having a foam-like or sponge-like shape, a large elasticity and a small percentage of vacant space.

COMPARATIVE EXAMPLE 4

Properties of composite fibers and non-woven fabric prepared under the same conditions as in Example 1 except that stretching was carried out at 105° C., were as follows:

Stretched composite yarn:

| | |
|---|---|
| Number of crimps | 15 (crimps/25 mm) |
| Non-woven fabric: | percentage shrinkage in area 10%<br>percentage of vacant space 94.8%<br>Thickness 12 mm |
| Number of crimps after heat-treatment 25 (crimps/25 mm) | |

The non-woven fabric thus obtained was a particular one having a foam-like or sponge-like shape, a large elasticity and a small percentage of vacant space.

The non-woven fabrics obtained under the conditions of Comparative Examples 1, 3 and 4 develops latent shrinkage at the time of processing into non-woven fabrics, showing a large percentage shrinkage in area, producing unevenness of convex and concave parts on the surface, and having a reduced percentage of vacant space (porosity) compared with that in Example 1. In the case of the raw fibers of Comparative Example 1, about 20% thereof was detached into polypropylene component and polyethylene component.

The fibers of Comparative Example 2 did not generate latent shrinkage; the non-woven fabric was uniform on the surface and rich in shape stability, but since the ratio of peripheral length was so large that the type of the resulting composite fibers was close to sheath and core type, bulkiness of fibers was reduced, and the fibers had no elasticity.

EXAMPLE 3

The composite fibers and non-woven fabric prepared as in Example 1 except that a stretching ratio of 3.3 was used, had the following properties:

Stretched composite yarns:

| | |
|---|---|
| Number of crimps 8 | |
| Non-woven fabric: | percentage shrinkage in section 3<br>percentage of vacant space 96.5<br>thickness 11 mm |
| Number of crimps after heat-treatment 7 crimps/25 mm | |

COMPARATIVE EXAMPLE 5

The composite fibers and non-woven fabric prepared as in Example 1 except that a stretching ratio of 2.8 was used, had the following properties:

Stretched composite yarns:

| | |
|---|---|
| Number of crimps 12 | |
| Non-woven fabric: | percentage shrinkage in section 10<br>percentage of vacant space 94.9<br>thickness 12 mm |
| Number of crimps after heat-treatment 25 crimps/25 mm | |

The non-woven fabric thus obtained was a particular one having a foam-like or sponge-like shape, a large elasticity and a small percentage of vacant space.

EXAMPLE 4

To each of a crystalline polypropylene having an intrinsic viscosity of 1.40 and a hexane-soluble portion of 0.81% and a low pressure polyethylene having a M.I. of 22.4, was added an atactic polypropylene having an average molecular weight of 60,000 and a M.P. of 130° C. in an amount of 5% each, and the resulting blends were used as a first component and a second component, respectively. The ratio thereof was arranged to 40:60. The first component was melt-extruded at 310° C. and the second component at 270° C. to spin into side-by-side type composite fibers. After spinning, the first component had a flow rate of 16.1 and a melting point of 166° C. and the second component had a flow rate of 36.9 and a melting point of 130° C., thus the flow rate ratio was 2.3. The resistance to detachment of the unstretched yarns was 20.0 ($g/d \times 10^{-2}$) and the percentage of peripheral length of fiber section was 76%. The resultant fibers were stretched to 5 times at 120° C. and a bundle of the resulting fibers having spiral crimps of 5 crimps/25 mm were passed through a stuffer-box type crimper to form zigzag type mechanical crimps at 10 crimps/25 mm whereby crimps were changed to U-form.

Four of the tows of these fibers having a single filament denier of 18 and a total denier of 700,000 were collected and passed through a heating tube having a diameter of 50 m/m and a length of 5000 mm and a cooling tube connected thereto and having a length of 5000 m/m under the conditions of 145° C. in the heating tube and 20° C. in the cooling tube and a tow velocity of 1 m/min. whereby a product of rod-like structure having a uniform surface and subjected to melt-adhesion only at the surface layer part was obtained continuously and in stabilized manner. Number of crimps after heat treatment was 5 crimps/25 mm. The fused part of this structure was porous, water-permeable and suitable as a water-removing material in the application fields of civil engineering raw materials.

The composite fibers of the present invention prepared by adding, as a third component, atactic polypropylene to both the components had a resistance to detachment of components improved by more than two times. In the application fields where resistance to detachment is required e.g. in the cases requiring considerable friction in processing of fibers, fibers of the present example can be advantageously utilized.

EXAMPLE 5

A web having a unit weight of 300 $g/m^2$ was prepared by uniformly blending 45 g of the composite fibers obtained according to Example 1 (18 denier×64 mm) and 255 g of common polypropylene fibers (6 denier×64 mm). The resulting web was subjected to heat-treatment in a hot air drier at 145° C. for 5 minutes whereby there was obtained a wadding for kilt which was bulky but showed few surface fluff. The resultant wadding had a percentage shrinkage in area of zero, a percentage of vacant space of 97.8 and a thickness of 15 mm.

What is claimed is:

1. A process for preparing a non-woven fabric having a porous structure which consists of
   (a) forming a plurality of unstretched side-by-side composite fibers consisting of a first component comprised mainly of crystalline polypropylene and a second component composed mainly of at least one olefin polymer other than crystalline polypropylene, said second component
   having a melting point at least 30° C. lower than that of said polypropylene, and
   having a melt flow rate in the range of 1.5–5 times that of said polypropylene
   (b) stretching said unstretched composite fibers at a stretching temperature at or above 20° C. below the melting point of said second component at a stretching ratio of 3 or more,
   (c) incorporating said stretched fibers having 12 crimps or less per 25 mm into a web,
   (d) subjecting said web to heat treatment at a temperature higher than the melting point of said second component but lower than the melting point of said polypropylene whereby said non-woven fabric is stabilized mainly by melt adhesion of said second component of said composite fibers.

2. A process in accordance with claim 1 wherein said web additionally includes fibers selected from the group consisting of cotton, wool, viscose, rayon, glass fibers and asbestos.

3. A process in accordance with claim 1 wherein said web additionally includes fibers selected from the group consisting of natural fibers, semisynthetic cellulose acetate fibers, synthetic fibers and inorganic fibers.

4. A process according to claim 1 wherein said olefin polymer is an atactic polypropylene having an average molecular weight of 30,000 to 90,000 and a melting point of 100° to 140° C.

5. A process for preparing a non-woven fabric having a porous structure which consists of
   (a) forming a plurality of unstretched side-by-side composite fibers consisting of a first component comprised mainly of crystalline polypropylene and a second component composed mainly of polyethylene, said polyethylene
   having a melting point at least 30° C. lower than that of said polypropylene, and
   having a melt flow rate in the range of 1.5–5 times that of said polypropylene,
   (b) stretching said unstretched composite fibers at a stretching temperature at or above 20° C. below the melting point of said polyethylene and at a stretching ratio of 3 or more,
   (c) forming said stretched fibers having 12 crimps or less per 25 mm into a web,
   (d) subjecting said web to heat treatment at a temperature higher than the melting point of said polyethylene but lower than the melting point of said polypropylene whereby said non-woven fabric is stabilized mainly by melt adhesion of the polyethylene of said composite fibers.

6. A process according to claim 5 wherein said polyethylene has a melt index of 9 to 34 at 190° C. and under a load of 2,160 g.

7. A process according to claim 5 wherein said olefin polymer is an atactic polypropylene having an average molecular weight of 30,000 to 90,000 and a melting point of 100° to 140° C.

* * * * *